United States Patent [19]

Mills

[11] Patent Number: 5,064,343

[45] Date of Patent: Nov. 12, 1991

[54] GAS TURBINE ENGINE WITH TURBINE TIP CLEARANCE CONTROL DEVICE AND METHOD OF OPERATION

[76] Inventor: Stephen J. Mills, 6 Boswell Court, Union Street, Ashbourne, Derbyshire, England

[21] Appl. No.: 552,133

[22] Filed: Jul. 13, 1990

[30] Foreign Application Priority Data

Aug. 24, 1989 [GB] United Kingdom ..... 8919252

[51] Int. Cl.[5] ..... F01D 11/00; F01D 25/00

[52] U.S. Cl. ..... 415/173.3; 415/12; 415/115

[58] Field of Search ..... 415/12, 47, 48, 173.1, 415/173.2, 173.3, 115, 116; 60/39.75

[56] References Cited

U.S. PATENT DOCUMENTS

| | | | |
|---|---|---|---|
| 2,787,440 | 4/1957 | Thompson, Jr. | 415/47 |
| 3,814,313 | 6/1974 | Beam, Jr. et al. | 415/12 |
| 3,975,901 | 8/1976 | Hallinger et al. | 415/117 |
| 4,023,731 | 5/1977 | Patterson | 415/116 |
| 4,213,296 | 7/1980 | Schwarz | 415/116 |
| 4,730,982 | 3/1988 | Kervistin | 416/95 |
| 4,805,398 | 2/1989 | Jourdain et al. | 415/116 |
| 4,893,984 | 1/1990 | Davison et al. | 415/116 |

*Primary Examiner*—Edward K. Look
*Assistant Examiner*—Michael S. Lee
*Attorney, Agent, or Firm*—Oliff & Berridge

[57] ABSTRACT

The problem of excessive clearances being generated by rub occurring between the tips of turbine blades and the linings on shroud segments which surround the blades is addressed by way of providing a valve 42 of a metal of different coefficient of expansion than the shroud control ring 24. On ground running prior to take off of an associated aircraft, the valve diverts a cooling airflow away from the ring 24, thus causing it to run hot and expand radially. The shrouds 22 are thus moved away from the blade tips 40 and on take off, are sufficiently far away from the tips 42 as to avoid deep penetration of the lining 38 thereby. The higher temperature generated by take off affects the valve 40 and makes it expand rapidly, to open the cooling airflow paths to the ring 24 via the holes 46 and 50.

6 Claims, 3 Drawing Sheets

GAS TURBINE ENGINE WITH TURBINE TIP CLEARANCE CONTROL DEVICE AND METHOD OF OPERATION

This invention relates to ways and means for at least reducing some problems created by the different operating regimes of a gas turbine engine which is utilized as an aircraft powerplant.

More specifically the invention is directed at the problem wherein the tips of the turbine blades of the engine penetrate the linings of the shroud segments which surround them and so destroy the desired clearance therebetween, with resulting loss in efficiency in flight regimes other than take off.

Tip clearance devices comprise active devices and passive devices. The former involves extraneous mechanical, electro-mechanical or hydro-mechanical devices with which to move the shrouds. The latter normally involves using the different characteristics of materials, particularly the coefficients of expansion of different materials, to achieve the desired effect.

Typical examples of passive devices are disclosed in GB2087979B and published specification GB2026651A. The former discloses shrouds supported at one end by a sleeve, the coefficient of expansion of which is higher than that of structure which surrounds it. When the sleeve experiences a rise in temperature it expands radially, thus pivoting the shroud away from blade tips. On reaching the surrounding structure, the shroud expansion rate is slowed to that of the surrounding structure.

The latter specification discloses the control of the rate of radially inward movement of shroud segments, by hanging them from a control ring which has a lower coefficient of expansion than surrounding structure. This ensures that on engine deceleration, the shrouds do not move radially inwards with sufficient rapidity as to collide with the tips of adjacent blades.

The present invention seeks to provide a gas turbine engine with an improved tip clearance device.

The invention also seeks to provide an improved method of controlling the clearance between the tips of a stage of turbine blades and surrounding shroud segments in a gas turbine engine, which method comprises the steps of utilising a cooling airflow control valve of a metal the coefficient of expansion of which differs from that of structure which supports said shrouds, to prevent the flow of cooling air to said structure which movably supports said segments during ground running of said engine, so as to cause said structure to heat and expand and thereby move said shroud segments away from said blade tips so as to avoid deep penetration of said shroud segments by said blade tips on acceleration of the revolutions thereof during the take off of an associated aircraft.

The invention will now be described, by way of example and with reference to the accompanying drawings in which.

Figure 3:
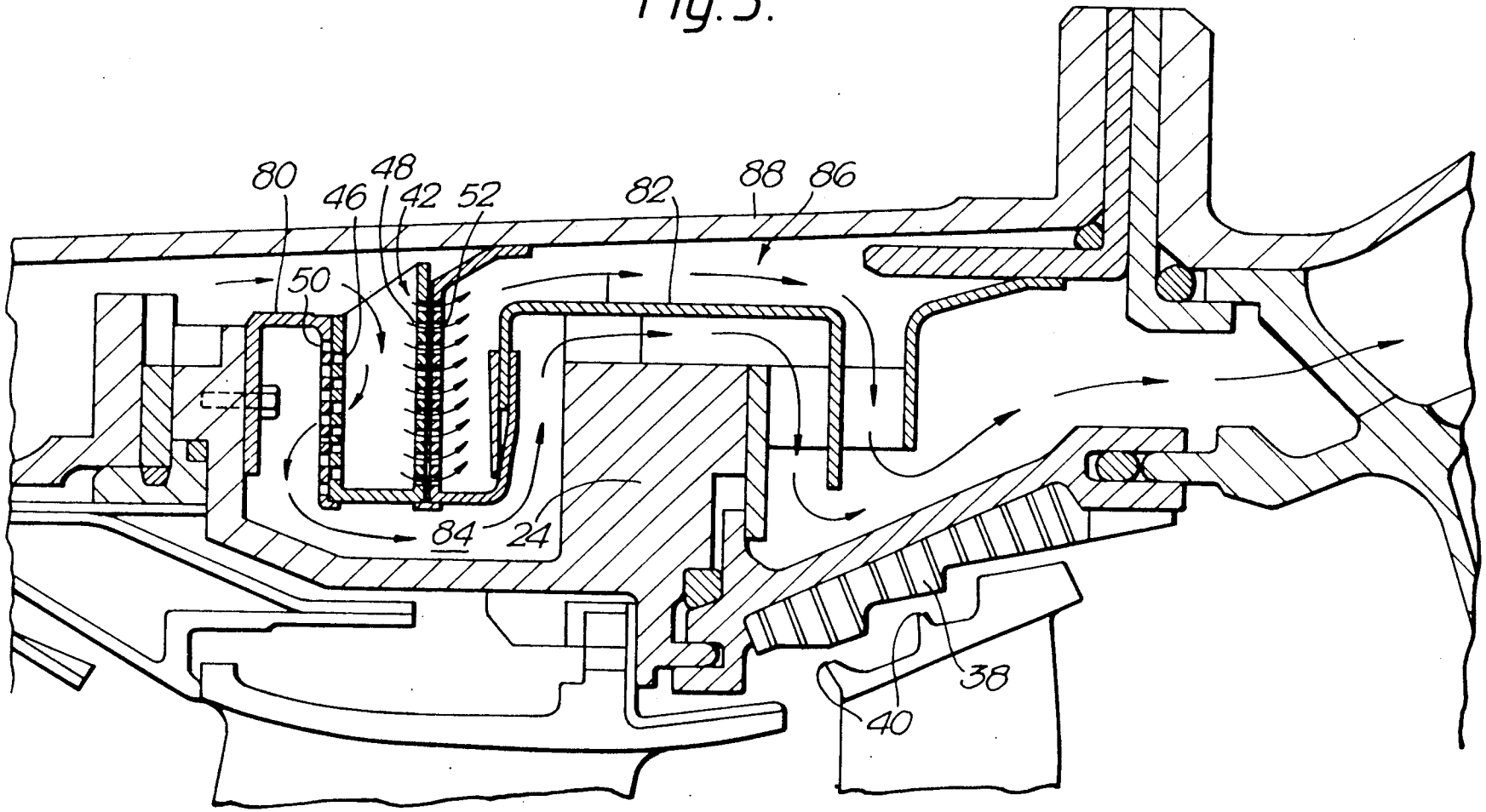
Figure 4:
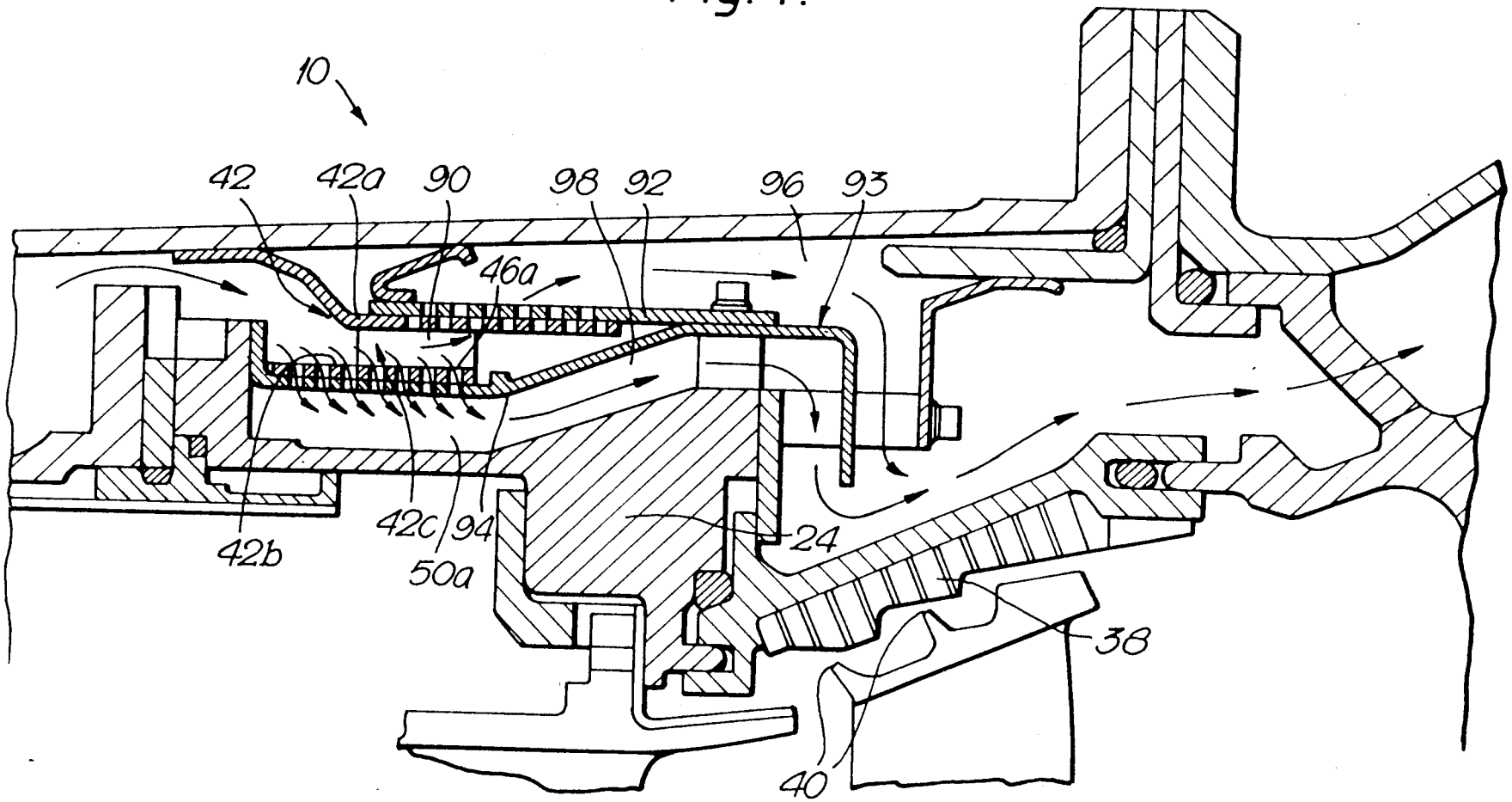

FIGS. 3 and 4 respectively depict further embodiments of the present invention.

Figure 1:
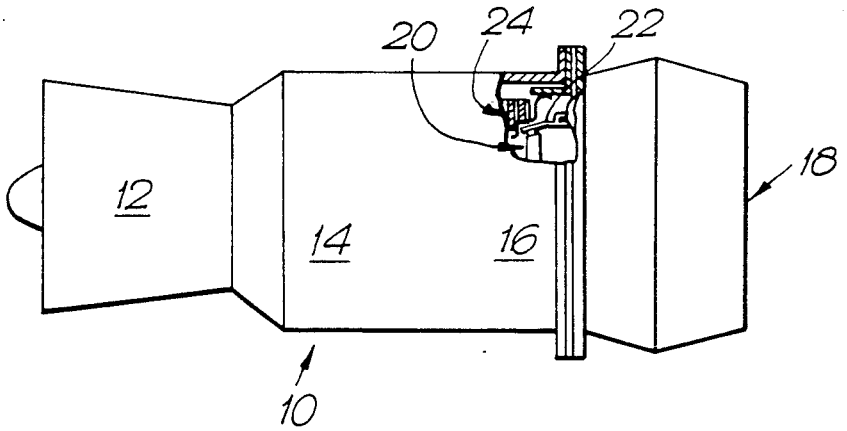
FIG. 1 is a diagrammatic view of a gas turbine engine which incorporates an embodiment of the present invention.

Referring to FIG. 1. A gas turbine engine 10 has a compressor 12, combustion equipment 14, a turbine section 16 and an exhaust nozzle 18, all of which are arranged in flow series.

A stage of blades 20 is surrounded by a segmented shroud 22 which is supported from fixed structure 24.

Figure 2:
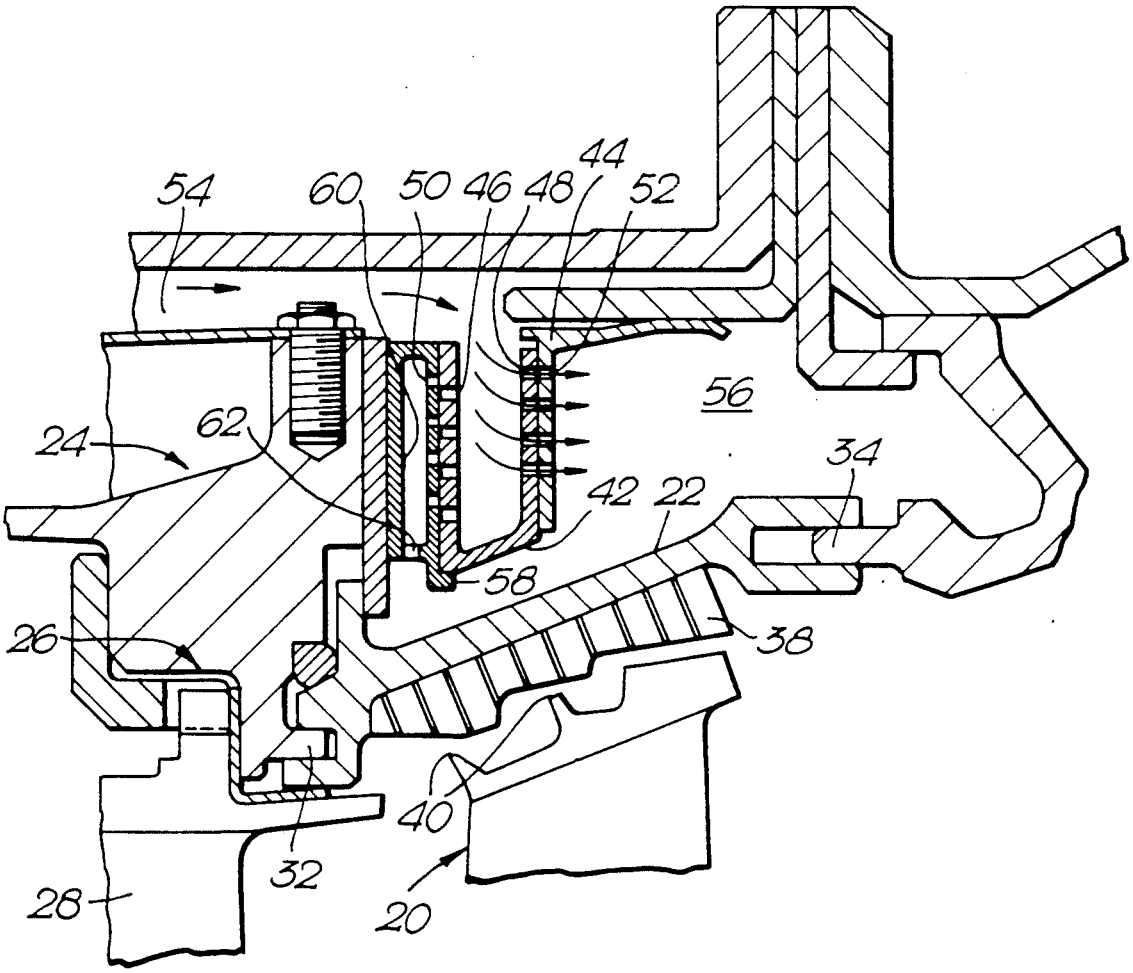
FIG. 2 is an enlarged, cross-sectional part view of the embodiment of the invention which is incorporated in the engine of FIG. 1.

Referring now to FIG. 2. The fixed structure 24 comprises a flanged cylinder, the internal profile of which provides locations 26 for nozzle guide vanes 28 in known manner. A further function of the cylinder 24 is to serve as a control ring for controlling movement of the shrouds 22 radially of the axis of rotation of the stage of turbine blades 20. Again this is a known function. The term "control ring" is a term of art in the gas turbine engine field and will be used hereinafter, when referring to part 24.

Radial movement of the control ring 24 is brought about by changes in temperature which occur as the engine 10 performs its operating cycles i.e. changing from power setting to power setting, low power to high power and back again, throughout the ground running and flight regime of an aircraft which is powered thereby.

Since each segment of the shroud 22 is positively located by a spigot 32 on the control ring 24, radial movement of the control ring 24 which is brought about by its expansion and contraction, causes each segment of the shroud 22 to pivot about its downstream end which is located on a further spigot 34 on further fixed structure 36. The pivoting occurs in a direction radially of the engine axis.

Each segment of the shroud 22 has an abradable lining 38 on its underside which in operation is engaged by the tips 40 of the blades in the stage 20, as they stretch through temperature increase and centrifugal forces. The blades thus wear a path for themselves which leaves a small spaced between them and the lining.

In prior art arrangements and as explained hereinbefore, the small spacing only occurred at maximum revolutions and therefor, thrust, of the engine, during take off of an associated aircraft. In the present invention however, there is provided hollow means in the form of a valve 42, which is held in sliding engagement between the structure of the control ring 24 and further fixed structure 44.

The valve 42 is made from a material which has a much higher coefficient of expansion than that of the material from which the control ring structure 24 is made. Consequently, in operation of the engine 10 which results in the control ring structure 24 and the valve 42 being exposed to a common temperature, the valve 42 will expand faster than the control ring structure 24.

The valve 42 is of segmented, annular construction and is "U" shaped in cross section as is seen in FIG. 2. The walls of the "U" have a respective regular pattern of holes 46,48 in them and both the control ring structure 24 and the further structure 44 have respective regular patterns of holes 50,52 therein which are respectively identical with the pattern of holes 46 and 48.

In FIG. 2, the relative positions of the stage of blades 20, the shrouds 22 and the valve 42 correspond to the situation wherein the engine 10 is at ground idle. Thus the holes 48 and 52 are aligned, but the holes 46 and 50 are not. Cooling air which is extracted from some suitable stage of the compressor 12 (FIG. 1) is taken via an annular passage 54 to the hollow interior of the valve 42, from which it them flows to a space 56 downstream of the control ring structure 24, via the holes 48 and 52. It thus bypasses the control ring structure 24 and a substantial portion of the shrouds 22. The consequence of this is that the control ring structure 24 and the shroud structure 22 heat up and expand, the effect being that the control ring structure 24 pivots the shroud structure 22 away from the tips of the rotating blades in the stage 20.

The extension of the stage of blades 20 through centrifugal force will be small at ground idle conditions.

The next step is for the associated aircraft to taxi to the take off point. Again engine temperature and revolutions are relatively low and the expanded control ring structure 24 will maintain the shroud structure 22 clear of the blade tips 40.

It should be appreciated that, although the control ring structure 24 is expanding, however slightly, the valve 42 at this stage will not, despite the fact that it has a higher coefficient of expansion. The cooling air which is passing through it is sufficient to maintain it in its non expanded conditions. Thus so far, the movement radially outwardly of the engine axis which the valve 42 makes, is brought about by the expansion of the control ring structure 24 via a lip 58 which engages the underside of each segment of the valve 42.

On take off of the associated aircraft, the engine 10 is accelerated to give full thrust. There results a rapid increase in both rate of revolutions of the stage of blades 20 and in temperature and the blades thus rapidly extend radially of the engine axis. Moreover, the increase in temperature via the control ring structure 24 affects the valve 42, the legs of the "U" of which grow. Two events now occur. The first of which is that the blade tips 40 catching up with the abrasive linings 38 of the shroud structure 22 and abrading an arcuate path therein. The abrasion however is not as deep as heretofor, because of the prior movement of the shroud structure 22 away from the stage of blades. The second event is that the holes 48 and 52 become malaligned and the holes 46 and 50 become aligned. Cooling air is then directed at the downstream face 60 of the control ring structure 24, downstream that is, relative to the flow of gases through the engine. After striking the downstream face 60, the cooling air passes radially inwardly through holes 62 and onto the shroud structure 22. There results a halt in the expansion of the control ring structure 24 and the shroud structure 22 and by this means, close spacing of the blade tips 40 and the abradable layer 38 is maintained during the take off regime of the associated aircraft.

On the associated aircraft reaching the desired cruise altitude the engine 10 is throttled by reducing the fuel flow to the combustion system 14 with consequent drop of speed of revolution of the turbine stage 20, and reduction in both the operating temperature and the centrifugal force which is experiences by the blades in the turbine stage 20. There results a contraction by all of the aforementioned parts, to respective dimensions which, though still greater than when the engine 10 is ground idling, are nevertheless of magnitudes which, in combination with the shallow groove worn in the abradable lining 38, ensure a close spacing of the lining 38 from the blade tips 40. That is, close relative to the spacing achieved at cruise conditions in prior art engines. There is thus a real gain in efficiency. In this operating condition, the cooperating patterns of holes 46 and 50 will overlap, as will the cooperating patterns of holes 48 and 52. The cooling airflow is thus divided such that the dimensional relationship of the various parts ensure the appropriate clearances.

Different designs of gas turbine engines inevitably result in differing operating conditions i.e. variation in temperature, mass flow of gases and cooling air, speed of rotation of the rotating parts and even the materials from which corresponding parts are made. It follows that for each engine which is designed to provide a given performance, hole patterns and hole sizes will have to be devised which will provide the required magnitude of cooling in the respective operating regime of that engine. Such patterns and sizes can be achieved by a combination of calculation and rig experiments.

Referring now to FIG. 3 in which like parts with those of FIG. 2 have been given like numerals.

The valve 42 is positioned upstream of the control ring 24 and is slidingly supported between an annular member 80 of inverted 'U' section and an annular sheet member 82 which is extended and formed so as to provide two cooling air flow paths, the first of which is numbered 84 and ducts cooling air via the valve 42 to the control ring 24.

The second flow path 86 is provided between the outer surface of the member 82 and engine casing structure 88, and enables the cooling air to by-pass the control ring and thus ensure that it becomes heated when by-passing occurs.

Patterns of holes 46,48,50 and 52 are provided in the walls of the valve 42 and in the walls between which it slides during operation of the engine 10, in the same way as in the example depicted in FIG. 2, so as to effect the same control over the temperature which is sensed by the control ring 24.

Referring to FIG. 4. Again the valve 42 is positioned upstream of the control ring 24, but is effectively rotated through 90°, so forming an annular structure comprised of nested rings **42*a* and 42*b* which define an annular space 42*c*. Radial struts 90** of which only one is shown, provide rigidity.

The valve 42 is arranged in axially sliding relationship between a further pair of fixed generally cylinders 92 and 94.

Cylinder 92 in combination with the engine casing 88 and an end 93 of the cylinder 94, provides a cooling air flow path 96 which by-passes the control ring 24. Cylinder 94 in conjunction with the control ring 24, provides a cooling airflow path 98 which when in use, ensures cooling of the control ring 24.

As shown in FIG. 4 the valve 42 is positioned such that cooling air passes via patterns of holes **46*a* and 50*a* along the passage 98 to cool the control ring 24. It may be assumed therefor, that the engine 10** is running at maximum take off power and temperature.

FIGS. 2 and 3 depict cooling air passing through holes 48 and 52 which ensures by-passing of the control ring 24. From this it may be assumed that the engine 10 is running at ground idle speed and the control ring 24 is being heated so as to increase the clearance between the tips 40 and the rubbing strip 38.

I claim:

1. A gas turbine engine including a blade tip clearance control system comprising an annular fixed control ring and further fixed structure downstream thereof, a ring of segmented blade shroud members supported between said fixed control ring and said further fixed structure in close spaced relationship with the tips of a stage of rotatable blades, double walled hollow valve means comprising an annular member the walls of which have patterns of holes therethrough and is constructed from a material which has a coefficient of expansion which differs from that of said control ring and supported for relative sliding movement between inlet walls to a first path which enables passage of cooling air to said control ring, and a second path which enables by-passing of said control ring by said cooling air, communication between a cooling air supply and said first and second paths being enabled via a said pattern hole in one or other of said walls of said annular member moving into alignment with holes in one or other of said inlet walls as a result of expansion or contraction of said annular member.

2. A gas turbine engine including a blade tip clearance control system as claimed in claim 1 wherein the double walled, hollow valve means comprises a generally cylindrical structure in which a pair of coaxial nested cylinders which have patterns of holes in their walls and are fixedly connected in annulus form spaced relationship via struts, and in communication with a cooling air supply, are nested in axial sliding relationship within a further pair of cylinders the walls of which have patterns of holes therein, said further pair of cylinders being fixed to and partially spaced from surrounding engine structure and said control ring so as to provide with the control ring said first cooling airflow path which enables cooling of said control ring, and with the surrounding engine structure s id second cooling airflow path which enables cooling air to bypass said control ring.

3. A gas turbine engine including a blade tip clearance control system as claimed in claim 1 wherein the double walled, hollow valve means comprises an annular 'U' section member, the walls of which have patterns of holes therethrough and are in sliding engagement with and between perforated annular flanges on ducting which surrounds said control ring in spaced relationship to provide with said cooling ring, said first cooling airflow path and with surrounding engine structure, said second cooling airflow path.

4. A gas turbine engine including a blade tip clearance control system as claimed in claim 1 wherein the double walled hollow valve member comprises an annular 'U' section member the walls of which have patterns of holes therethrough and are in radial sliding engagement with and between the radial face of an annular chamber which effectively provides a face of said control ring, and the radial face of a flange which forms a part of engine structure downstream of said control ring, said radial faces having respective patterns of holes therethrough so as to provide with said holes in said walls of said annular 'U' section member, said first and second cooling airflow paths.

5. A gas turbine engine including a blade tip clearance control system as claimed in claim 1 including abutment lips on the structure in which said hollow valve means slides, which limit the distance over which said hollow valve means can slide.

6. A method of controlling the clearance between the tips of a stage of turbine blades and surrounding shroud segments in a gas turbine engine, comprising the steps of utilizing a double-walled, hollow cooling airflow control valve of a metal, the coefficient of expansion of which differs from that of a control ring which supports said shrouds in spaced relationship with the tips of said stage of turbine blades, by putting said valve in communication with a cooling air supply and causing said valve to effect a change in its proportions so as to enable passage of cooling air therethrough or to bypass and divert said cooling air from said control ring so as to in turn change the proportions of the control ring and thereby move said shroud segments towards or away from said blade tips.

* * * * *

UNITED STATES PATENT AND TRADEMARK OFFICE

CERTIFICATE OF CORRECTION

PATENT NO. : 5,064,343

DATED : November 12, 1991

INVENTOR(S) : Stephen J. MILLS

It is certified that error appears in the above-indentified patent and that said Letters Patent is hereby corrected as shown below:

On the cover page, please insert --[73] Assignee: Rolls-Royce plc, London, England--.

Signed and Sealed this

Ninth Day of August, 1994

*Attest:*

Bruce Lehman

BRUCE LEHMAN

*Attesting Officer*

*Commissioner of Patents and Trademarks*